United States Patent [19]

Inagawa et al.

[11] 3,978,893

[45] Sept. 7, 1976

[54] APPARATUS FOR DETECTING SUCCESS IN WEFT INSERTION OF SHUTTLELESS LOOMS

[75] Inventors: Mitsugu Inagawa, Shizuoka; Isamu Miyazaki, Hamamatsu, both of Japan

[73] Assignee: Enshu, Limited, Shizuoka, Japan

[22] Filed: Sept. 22, 1975

[21] Appl. No.: 615,475

[30] Foreign Application Priority Data

Sept. 26, 1974 Japan ..... 49-116452[U]
Nov. 13, 1974 Japan ..... 49-131427

[52] U.S. Cl. ..... 139/370.2
[51] Int. Cl.[2] ..... D03D 51/34
[58] Field of Search ..... 139/336, 370.1, 370.2, 139/194; 66/163

[56] References Cited

UNITED STATES PATENTS

| | | | |
|---|---|---|---|
| 3,532,138 | 10/1970 | Schlappi | 139/370.2 |
| 3,658,098 | 4/1972 | Mullekom | 139/194 |
| 3,744,533 | 7/1973 | Yano et al. | 139/370.2 |
| 3,908,710 | 9/1975 | Mullekom | 139/194 |

*Primary Examiner*—Henry S. Jaudon
*Attorney, Agent, or Firm*—Burgess Ryan and Wayne

[57] ABSTRACT

On shuttleless looms on which wefts are inserted into sheds being carried on air or water jet flow, the leading end of the inserted weft is urged sideways to move forward across a detecting zone of a photoelectric detection mechanism fixed forward of the cross-fell line by a pair of forks on the lathe which assume a position forward of the cloth-fell line at the very moment of cloth-fell beating and is held in a limited space on the forward side of the detecting zone, thereby non-contact type photoelectric detection of success in weft insertion being practiced without faulty double detection to be caused by whipping of the weft end. For water jet looms, occurence of noises in the detection to be caused by wetting can be prevented by provision of pneumatic air blowing devices, and waterproof sheltering arrangements for the photoelectric system that permits the passage of light as well as the passage of the weft end.

25 Claims, 14 Drawing Figures

APPARATUS FOR DETECTING SUCCESS IN WEFT INSERTION OF SHUTTLELESS LOOMS

BACKGROUND OF THE INVENTION

The present invention relates to apparatus for detecting success in weft insertion on shuttleless looms, more particularly relates to improvement in the apparatus for detecting success in weft insertion in photoelectric manner on looms on which wefts are inserted into sheds being carried on air or water jet flow ejected from a nozzle located on one side of the loom width.

In the case of the known non-contact type photoelectric system for shuttleless looms of the above-described kind, a light source and a photoelectric cell are arranged being spaced from each other on the trimmed selvage side of the loom width and their operating terminals, i.e. the light emitting and the light receptive terminals, confront to each other while defining a detecting zone between them. The arrangement is so designed that, upon successful arrival of the inserted weft at the trimmed selvage side of the loom width, the leading end of the weft passes across the detecting zone and the photoelectric system detects the success in the weft insertion.

In order to carry out the above-described photoelectric detection successfully always, it must be assured that the leading end of the inserted weft always passes across the detecting zone without fail. When the leading end of the weft flys outside of the prescribed detecting zone, the photoelectric system cannot sense the presence of the weft end, the weft insertion is judged as being ended in failure and the corresponding signal from the photoelectric system stops the loom running. In actual weaving, it often happens that the leading end of the interested weft dances or whips upon arrival at the trimmed selvage side and such dancing and whipping tend to cause the weft end to fly just outside of the photoelectric detecting zone and, thereby, unnecessary stoppage of the loom running results.

The unnecessary stoppage of the loom running of this kind causes fatal lowering in tne production efficiency especially when the photoelectric detecting system is employed in combination with the unattended continuous mass running system in weaving mills, which currently shows a rapid penetration into the textile industry all over the world.

In addition to the above-described drawbacks in the conventional photoelectric system, it should be noted that, even when the weft end once passes across the detecting zone successfully, its dancing and/or whipping may cause faulty double detection by the detecting mechanism.

The primary object of the present invention is to provide apparatus for reliably detecting success in weft insertion on shuttleless looms without any ill influence by the dancing and/or whipping of the weft end upon arrival at the trimmed selvage side.

A further trouble may arise when the photoelectric detection system is used on so-called water jet looms. As already described, weft is inserted into sheds being entrained on water jet flow and, therefore, the leading end of the weft is usually wetted. When the wet weft end passes across the detecting zone, water drops accompanying the weft end tend to fly to the surfaces of the operating terminals of the light source and the photoelectric cell. Presence of such water drops on the operating terminal surfaces and covering of the surfaces with water layers tend to lower the detecting ability of the photoelectric system, i.e. they tend to produce undesirable noises in the detection.

The other object of the present invention is to provide apparatus particularly suited for detecting success in weft insertion on water jet looms being free of noises produced by wetting of the photoelectric system.

BRIEF DESCRIPTION OF THE INVENTION

In order to attain the above-described object, the apparatus of the present invention is provided with the following basic construction. That is, a pair of forks are disposed to the lathe in such an arrangement that they assume a position forward of the cloth-fell line when the lathe assumes its foremost position, i.e. at the very moment of cloth-fell beating. In combination with the forks, a detection mechanism is fixed to the loom framework on the forward side of the cloth-fell line, which is provided with a photoelectric detecting zone near the rear end thereof and a center gap on the forward side of the detecting zone. The lateral distance between the pair of forks is chosen larger than the maximum width of the detection mechanism. During the beating motion, the forward moving forks urge the weft end sideways to move forward across the cloth-fell line and the photoelectric zone and into the center gap which is so constructed as to hinder rearward jumping of the weft end once introduced into the gap.

In a preferred embodiment of the present invention, the forks are fixed to the front surface of the reed cap immovably whereas, in another preferred embodiment of the present invention, the forks are so disposed to the lathe as to be positively moved forward with respect to the lathe at the very moment of cloth-fell beating.

In a further preferred embodiment of the present invention, pneumatic flowing is applied to one of the operating terminals of the photoelectric system elements and the other of the operating terminals is covered with a transparent material layer.

In a further preferred embodiment of the present invention, a resilient shelter is disposed to the rear end of the detection mechanism, which isolates the photoelectric detecting system from the passing ambit of the wet weft end.

DETAILED DESCRIPTION OF THE INVENTION

Figure 1:
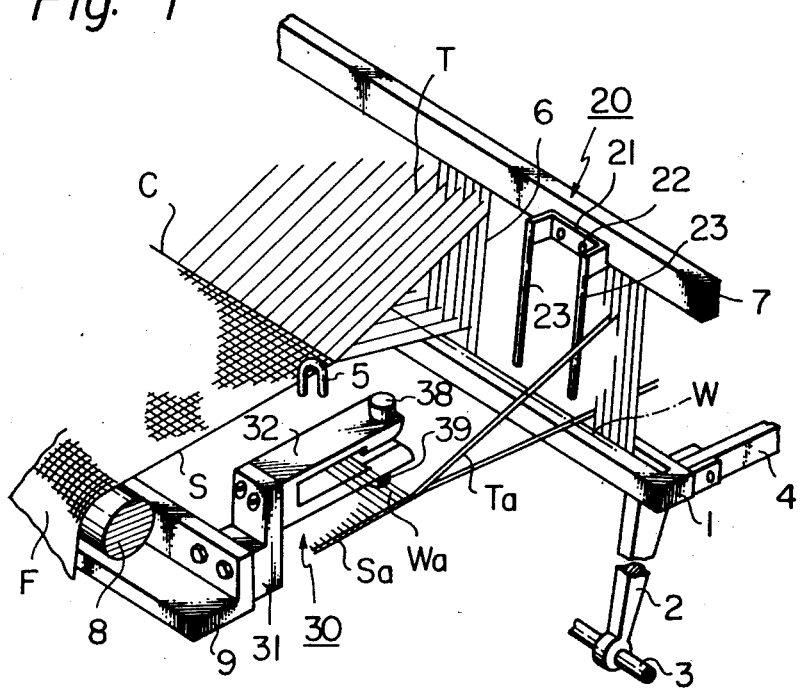
FIG. 1 is a perspective plan view of one embodiment of the present invention and its related parts.

A basic embodiment of the present invention is shown in FIG. 1, in which the construction and arrangement around the cloth-fell is substantially similar to those of the conventional loom. Namely, a lathe 1 is carried by a pair of lathe swords 2 which are, at their bottom ends, mounted on a rocking shaft 3. A pair of crank arms 4 are pin joined to the backside of the lathe 1 in order to cause the rocking movement of the lathe 1 and the lathe sword 2 about the rocking shaft 3 as the loom runs. A reed 6 in cooperation with a reed cap 7 are located above the lathe 1.

Warps T run through the reed 6 and are grouped, at the time of the shedding motion, into a pair of upper and lower sheets in order to form an open shed as shown in the drawing. The weft W is inserted into the open shed by an ejection nozzle not shown in the drawing but suitably mounted to the loom framework on the other side of the warp sheet. The weft W so inserted is pressed against the cloth-fell C by the reed 6 at the time of the beating motion in order to weave a fabric F. As the weaving operation goes on, the fabric F so woven is advanced forwardly and taken up by a take-up device (not shown) located at the lower front of the loom framework via a breast roller 8 provided on the front side of a breast beam 9 fixed to the loom framework.

Being somewhat spaced sideways of the selvage side warp T, there run some ends of additional warps Ta, in parallel with the run of the warps T, through the reeds 6. The additional warps Ta are interlaced with weft ends Wa as the weaving operation goes on in order to hold and tension the wefts W. As the picking is repeated, weft ends Wa interlaced with the additional warps Ta move forwardly and are cut off the associated wefts W through contact with a heat cutter 5, which is provided at a suitable position closely sideways of a selvage S of the fabric F. Thus, the weft ends Wa interlaced with the additional warps Ta produces a trimmed selvage Sa which runs substantially parallel to the selvage S of the fabric F. A separate take-up device (not shown) is provided on the loom in order to take up the trimmed selvage Sa as the weaving operation goes on.

The above-described construction, arrangement and operation of the parts around the cloth-fell C is substantially similar to those on the conventional looms.

In combination with the above-described arrangement, the apparatus in accordance with the present invention comprises a mechanism for displacing the weft ends Wa forwardly beyond the cloth-fell C at the very moment of the beating motion and disposed to the reed cap 7 and its related parts and a mechanism for detecting the presence of the weft ends Wa. The former will hereinafter be referred to as "the displacement mechanism 20" and the latter as "the detection mechanism 30".

The displacement mechanism 20 comprises a base 21 fixed to the front surface of the reed cap 7 via set screws 22 whose side ends are bent somewhat forwardly and a pair of forks 23 joined in one body to the bent ends of the base 21 and extending downwardly.

Dimensional detail of the displacement mechanism 20 will be later explained in relation to that of the detection mechanism 30.

Figure 2:
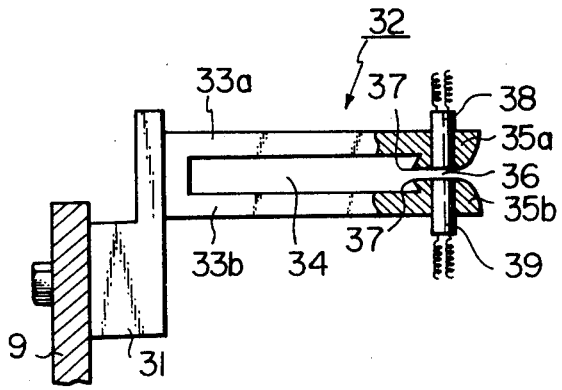
FIG. 2 is a side plan view, partly in section, of one embodiment of the detecting mechanism used in the apparatus of the present invention.

Detail construction of the detection mechanism 30 is shown in FIG. 2, in which a bracket 31 fixed to the backside surface of the breast beam 9 fixedly carries, on its backside, an weft end holding block 32. As shown in the drawing, the holding block 32 includes a pair of upper and lower tongues 33*a* and 33*b* extending rearwardly while leaving a center gap 34 between them. The rear end portions 35*a*, 35*b* of the tongues 33*a* and 33*b* are formed thicker than the remaining parts thereof while leaving a weft end passage 36 between them. The rear surfaces of the end portions 35*a* and 35*b* are formed round so that the curves merge into the weft end passage 36. The weft end passage 36 inwardly merges into the center gap 34 of the holding block 32 and, at the border between the passage 36 and the center gap 34, hooks 37 are formed on the inner surfaces of the end portions 35*a* and 35*b*. Vertically through the end portions 35*a* and 35*b*, there are provided a light source 38 and a photoelectric cell 39, their operational terminals opening in the weft end passage 36 in spaced confrontation with each other. The light source 38 is connected to a given electric power source (not shown) whereas the cell 39 is electrically and operationally connected to a suitable equipment (not shown) for stopping the running of the loom automatically when absence of the weft is detected. Although the light source 38 is disposed to the upper tongue end portion 35*a* and the cell 39 to the lower tongue end portion 35*b*, this arrangement can be reversed without falling out of the scope of the present invention.

The arrangements and dimensions of the both mechanisms 20 and 30 are settled as follows. The lateral position of the holding block 32 should be between the selvage S of the fabric F and the trimmed selvage Sa and the warp directional position of same should be so designed that the positions of the hooks 37 are somewhat rearward of the weft end Wa which has been brought to the foremost position being urged by the forks 23 at the very moment of the beating motion. (see FIG. 3B) The lateral distance between the pair of forks 23 should be larger than the width of the holding block 32. The length of the forks 23 should be so designed that, at the foremost position of same, the lower ends of the forks 23 are lower than the bottom of the center gap 34 of the holding block 32.

With the above-described construction, arrangement and dimension, the apparatus of the present invention operates in the following manner, reference being made to the illustrations in FIGS. 3A and 3B.

Figure 3A:
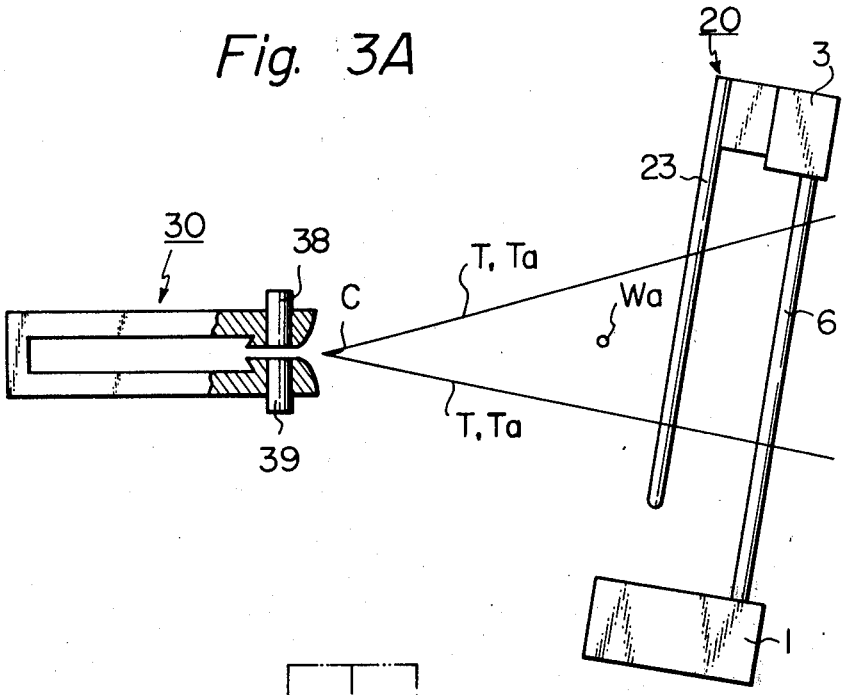
FIGS. 3A and 3B are explanatory side plan views, partly in section, for showing operation of the apparatus shown in FIG. 1, FIGS. 4A through 4C are explanatory plan view for showing operational sequence of the apparatus according to the present invention.
Figure 4A:
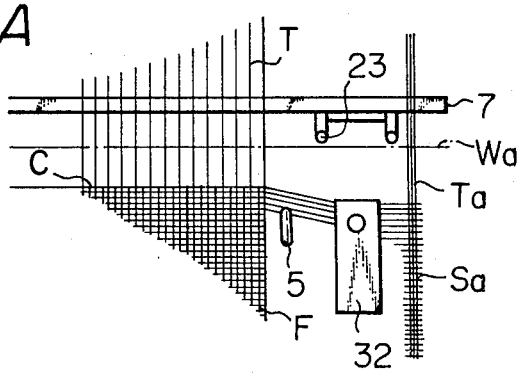

In the disposition shown in FIG. 3A, the crank of the loom assumes the back dead center, the lathe 1 and the forks 23 assume their rearmost positions, the weft W is inserted by the ejecting nozzle into the open shed and the weft end Wa advances in front of the forks 23 through the open sheds formed by the warps T and the additional warps Ta. (see FIG. 4A)

Figure 4B:
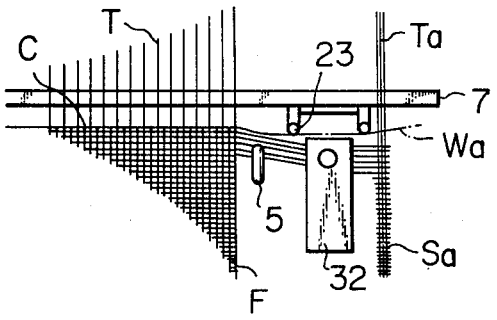

As the beating motion starts, the forks 23 move forwardly with the lathe 1 and urge the weft end Wa forwardly. With further advance of the beating motion, the weft end Wa so urged by the moving forks 23 moves forwardly beyond the position of the cloth-fell C of the fabric F and, upon arrival at the rear end of the holding block 32 of the detection mechanism 30, is introduced into the passage 36 being guided by the roundly curved rear end of one of the tongue end positions 35*a* and 35*b*. (see FIG. 4B) The forward movement of the forks 23 is not hindered by the presence of the holding block 32 as the lateral distance between the pair of forks 23 is larger than the width of the holding block 32 as already explained. During the travel through the passage 36, the weft end Wa crosses the detection zone between the light source 38 and the photoelectric cell 39 and the detection beam from the light source 38 is interrupted by the weft end Wa. This interruption naturally causes corresponding reduction in the intensity of light to be received by the photoelectric cell 39 and this leads to corresponding change in the electric quantity of the output by the photoelectric cell 39, by which the presence of the weft end Wa, i.e. the success in the weft insertion, is sensed.

Figure 3B:
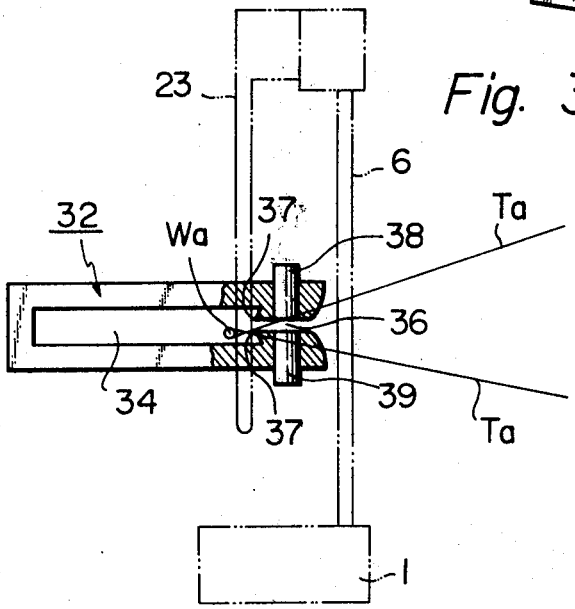
Figure 4C:
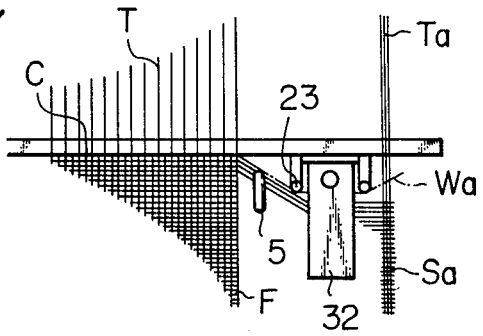

When the forks 23 assume their foremost position as shown with two-dot chain lines in FIG. 3B, i.e. at the very moment of the weft beating, the weft end Wa is brought into the center gap 34. (see FIG. 4C)

During the procedure so far, the weft W, i.e. the weft end Wa, is kept in a tensed condition thanks to the interlacing with the additional warps Ta and, therefore, the weft end Wa can be successfully introduced into and moved forwardly through the passage 36 of the holding block 32. This stable condition of the weft end Wa during the travel through the passage 36 assures elimination of such malfunctions as double detection and unsuccessful detection, both often caused by whipping or jumping of the weft end. When the weft insertion has ended in failure, forward movement of the forks 23 does not accompany that of the weft end Wa, no interruption of the beam from the light source 38 takes place, no change will occur in the output from the photoelectric cell 39 and the equipment connected to the cell 39 operates to stop the running of the loom.

After completion of the beating, the lathe 1 with the reed 6 moves rearwardly away from the cloth-fell C until it resumes the initial disposition shown in FIG. 3A. However, the weft end Wa in the center gap 34 of the holding block 32 does not follow this rearward movement as the rearward movement of the weft end Wa is hindered by one of the hooks 37. Thus, regardless of the rearward movement of the lathe 1 and its related parts, the weft end Wa is surely held and maintained within the holding block 32. This hindrance of the rearward movement of the weft end Wa effectively prevents occurrence of undesirable double detection by the photoelectric equipment.

Figure 5:
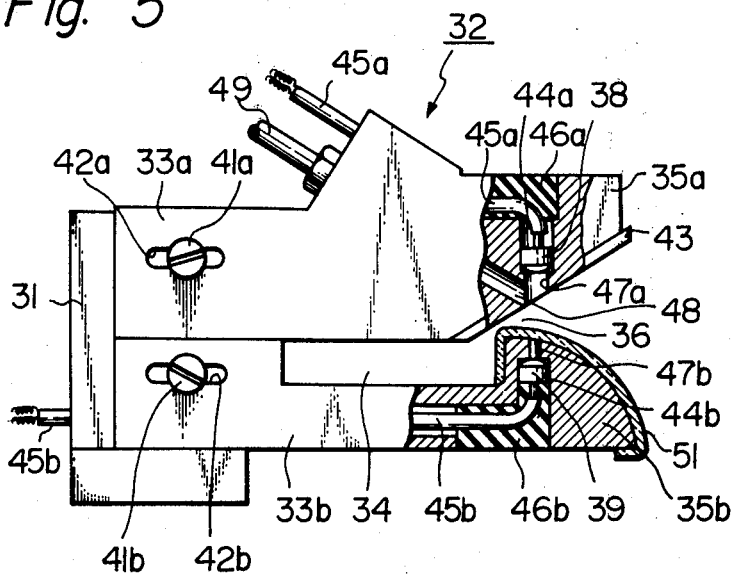
FIG. 5 is a side plan view, partly in section, of another embodiment of the detecting mechanism used in the apparatus of the present invention.
Figure 6:
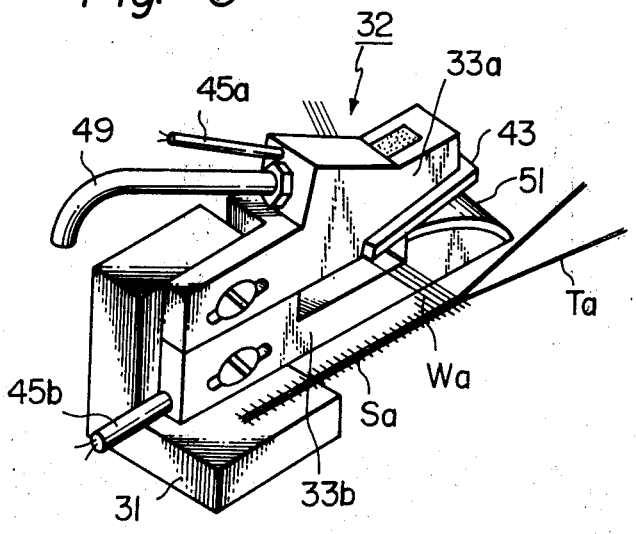
FIG. 6 is a perspective plan view of the mechanism shown in FIG. 5.

A different embodiment of the detection mechanism 30 is shown in FIGS. 5 and 6, in which parts substantially similar in function to those of the embodiment shown in FIGS. 1 and 2 are designated with similar reference numerals. The detection mechanism of this type is particularly suited for use on water jet looms on which weft are inserted into open sheds by water ejected from ejection nozzles. As the weft arrives at the trimmed selvage side in wet condition and accompanied with water drops, the water drops may wet the terminals of the light source 38 and the photoelectric cells 39 exposed to the weft end passage 36 when the weft end is introduced into the holding block 32 of the detection mechanism 30. This wetting of the detection system tends to lower the function of the photoelectric detection system. In other words, undesirable noises are generated in the weft detecting operation and such noises later cause unsuccessful weft detection.

Therefore, when the detection mechanism is to be used for water jet looms, particular consideration needs to be paid to the construction of the detection mechanism in order to safely guard the photoelectric detection system from ill influence by wetting of the weft end.

As shown in the drawing, the holding block 32 of this embodiment is made up of a pair of separate upper and lower tongues 33*a* and 33*b* which are fixed to the bracket 31 by set screws 41*a* and 41*b* via horizontal slots 42*a* and 42*b*. Thanks to the provision of the slots 42*a* and 42*b*, the position of the holding block 32 can be somewhat adjusted in the warp direction.

The rear end portion 35*a* of the upper tongue 33*a* has a lower sloped surface rising rearwardly and the edge of this sloped surface is covered by an eaves 43 which so functions as to guide water flowing down from the end portion 35*a* to the interior of the center gap 34. Due to the provision of the eaves 43, the water flowing down from the end portion 35*a* to the interior of the center gap 34 can be prevented from flowing into the weft end passage 36, thereby preventing the wetting of the weft end passage 36.

A vertical cavity 44*a* is formed through the rear end portion 35*a* of the upper tongue 33*a* and this cavity 44*a* accommodates the light source 38 which is connected to the given electric source via an electric connection 45*a*. The electric connection 45*a* runs through an electric insulator 46*a* embedded in the upper surface of the rear end portion 35*a* and, further through the body of the upper tongue 33*a*. The above-described cavity 44*a* downwardly merges into a beam path 47*a* opening in the weft end passage 36.

An air conduit 48 is formed through the body of the upper tongue 33*a* with the downstream terminal thereof, opening in the beam path 47*a* in such an arrangement that the air ejected therefrom flows rearwardly and downwardly across the beam path 47*a* and the weft end passage 36. The upstream terminal of the air conduit 48 is coupled to an air pipe 49 which is connected to a given pneumatic supply source (not shown). The intensity of the air flow from the air conduit should be so adjusted that it does not blow away the weft end introduced into the weft end passage 36.

The rear end portion 35*a* of the lower tongue 33*b* has an upper round curved surface lowering rearwardly and this curved surface is covered by a transparent pane 51 which assures smooth forward displacement of the weft end urged by the forks 23. As later described, this pane 51 effectively prevents the photoelectric cell 39 from wetting without any hindrance to the passage of the detection beam.

A vertical cavity 44*b* is formed in the rear end portion 35*b* of the lower tongue 33*b* and this cavity 44*b* accommodates the photoelectric cell 39 which is connected to the given automatic equipment for stopping the loom running via an electric connection 45*b*. The electric connection 45*b* runs through an electric insulator 46*b* embedded in the lower surface of the rear end portion 35*b* and, further, through the body of the lower tongue 33*b*. The above-described cavity 44*b* upwardly merges into a beam path 47*b* whose opening in the weft end passage 36 is closed by the transparent pane 51. Thus the pane 51, on one hand, prevents the flow of water into the beam path 47*b* and, on the other hand, allows smooth passage of the detection beam due to its transparency.

Figure 7:
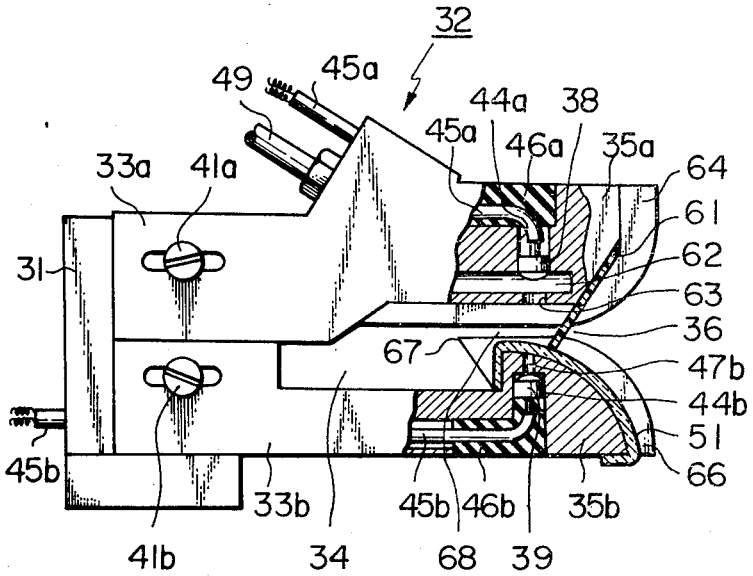
FIG. 7 is a side plan view, partly in section, of a further embodiment of the detecting mechanism used in the apparatus of the present invention.
Figure 8:
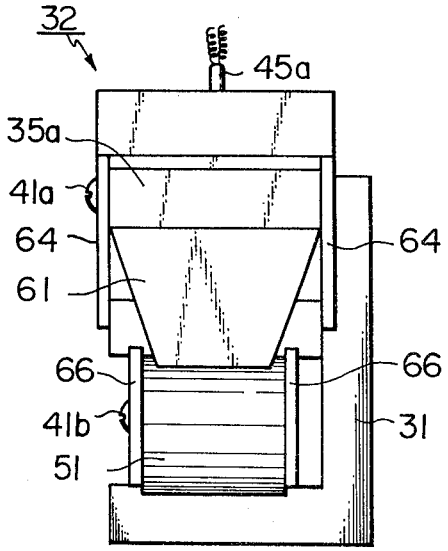
FIG. 8 is a rear plan view of the mechanism shown in FIG. 7.

A modification of the embodiment shown in FIGS. 5 and 6 is shown in FIGS. 7 and 8, in which parts of substantially similar construction and/or function are designated with similar reference numerals.

Instead of the eaves 43 used in the foregoing embodiment, a lip 61 made up of an elastic material is disposed to the rear lower end of the end portion 35*a* of the upper tongue 33*a*. The lip 61 hangs down over the transparent pane 51 and its lower end contacts the upper surface of the pane 51. An air conduit 62 is formed horizontally through the body of the upper tongue 33*a* into which the light emitting terminal of the light source 38 is exposed. This air conduit 62 is upstream connected to the air pipe 49. In line with the center axis of the light source 38, a beam path 63 is formed through the end part 35*a* downwardly opening in the weft end passage 36.

On both sides of the end portion 35*a* of the upper tongue 33*a*, there are provided a pair of upper guide plates 64 whose rear lower ends are curved roundly. In combination with the upper guide plates 64, a pair of lower guide plates 66 are disposed to both sides of the end portion 35*b* of the lower tongue 33*b*. The confronting edges of the upper and lower guide plates 64 and 66 leave a gap 68 between in order to allow the passage of the weft end Wa urged by the forward movement of the forks 23. The rear ends of the lower guide plates 66 are curved roundly in accordance with the curvature of the transparent pane 51 and the forward ends thereof are formed in the shape of hooks 67 in order to bar the rearward jamp-out of the weft end Wa once introduced into the center gap 34.

Provision of the lip 61 in this embodiment effectively prevents invasion of water drops accompanying the weft end Wa into the inner side of the weft end passage 36, air blowing on the exposed light emitting terminal of the light source 38 keeps the terminal always dry and provision of the guide plates 64 and 66 eliminates direct frictional contact of the weft ends Wa with the transparent pane 51 and the parts defining the weft end passage 36.

In the case of the embodiments explained so far, the displacement mechanism 20 is fixed to the reed cap 7 and immovable with respect to the reed cap 7. That is, only the forward movement of the lathe 1 and its related parts is utilized in urging the weft end for movement towards the detection mechanism 30. As a substitute for this, FIG. 9 shows an embodiment in which the displacement mechanism 20 is disposed to the lathe 1 but movable with respect to the lathe 1.

Figure 9:
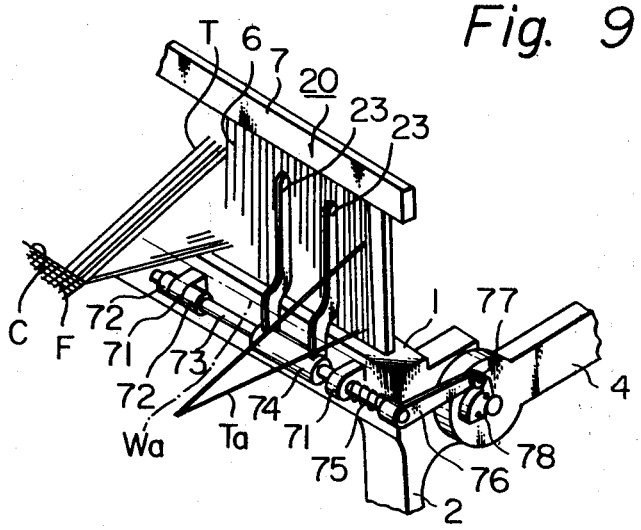
FIG. 9 is a perspective plan view of another embodiment of the displacement mechanism used in the apparatus of the present invention.

In the construction shown in FIG. 9, a pair of bearings 71 are fixed to the front surface of the lathe 1 being adequately spaced from each other along the length of the lathe 1. A shaft 73 is carried by the bearings 71 in an axially turnable disposition and its movement in the axial direction is restricted by a pair of set collars 72 fixedly mounted to the shaft 72 on both sides of the inner side bearing 71.

At a position midway of the pair of bearings 71, a boss 74 is fixedly mounted to the shaft 73 and the boss 74 carries in one body a pair of forks 23 standing upwardly. The outer end of the shaft 73 is fixedly coupled to a connecting lever 76 which extends rearwardly and, at its rear end, turnably carries a cam follower roller 77. A pseudo sector-shaped cam 78 is fixed to the side surface of the crank arm 4 at the very junction thereof with the lathe sword 2. A coil spring 75 is disposed to the shaft 71 in the area between the outer side bearing 71 and the junction to the connecting lever 76 in such a manner that it always urges the cam follower roller 77 into pressure contact with the cam 78 and keeps the forks 23 upright in contact with the reed 6.

As the beating motion starts and the lathe 1 moves forwardly, the cam 78 turns the shaft 73 in the counterclockwise direction in the drawing via the connecting lever 76 while overcoming repulsion by the spring 78 and the forks 23 swing forwardly about the axis of the shaft 73. At the very moment that the reed 6 beats the cloth-fell C, the forks 23 tilt forward across the cloth-fell line and the weft end Wa is forced to come into engagement with the detection mechanism 30. As the lathe 1 moves rearwardly off the cloth-fell C after the beating, the forks 23 tend to resume their original posture on the lathe 1 due to the repulsion by the coil spring 75, as the accompanying turning of the cam 78 allows clockwise turning of the shaft 73 in the drawing.

By changing the profile of the cam 78, the movement of the forks 23 for urging the weft end Wa can be adjusted as desired independently of the movement of the lathe 1 as the displacement mechanism 20 is directly related to the crank arm 4 although the same is mounted to the lathe 1. This freedom in the adjustment of the forks' motion assures increased freedom in the design of the apparatus according to the present invention in accordance with variety in the weaving design, weaving operation, weaving condition and weaving looms.

Figure 10A:
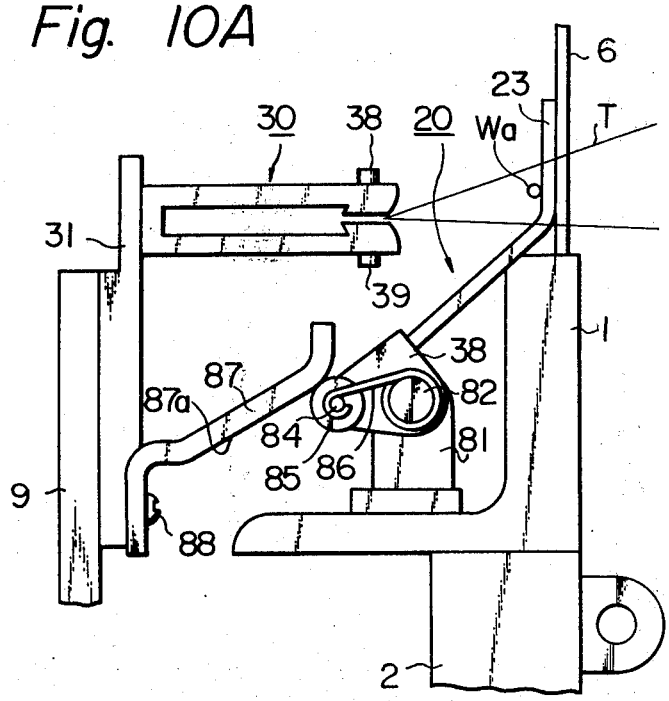
FIGS. 10A and 10B are explanatory side plan views for showing operation of a further embodiment of the displacement mechanism used in the apparatus of the present invention.
Figure 10B:
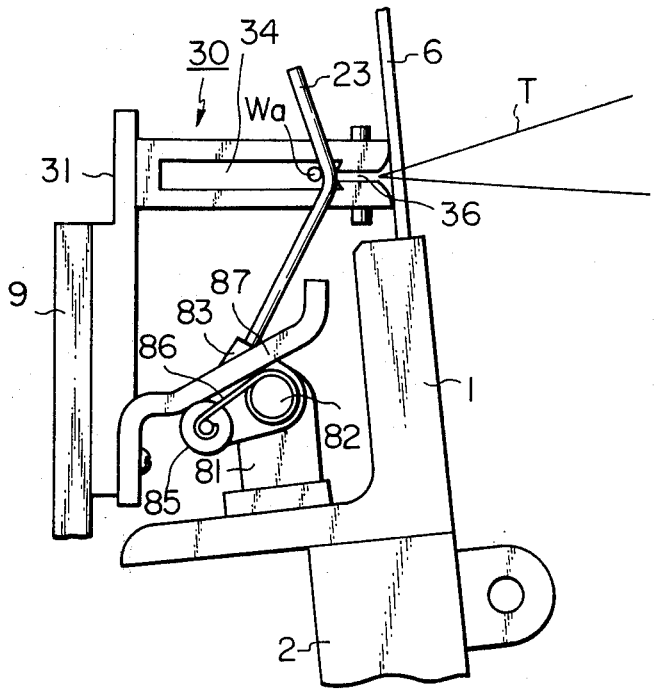

A modification of the apparatus in which the forks 23 is movable with respect to the lathe 1 and its related parts is shown in FIGS. 10A and 10B. Referring to FIG. 10A, a stand 81 is fixed on the front extension of the lathe 1 and a horizontal pin 82 is fixed to the side surface of the stand 81 at a position near the top thereof. A supporting plate 83 of a reverse U-shaped transversal cross sectional profile is pivoted at its both side wall parts on the horizontal pin 82 and fixedly carries at its front end a horizontal pin 84 on which a cam follower roller 85 is rotatably mounted. The supporting plate 83 further fixedly carries a pair of forks 23 which extends rearwardly and upwardly. The forks 23 are bent at about the midway thereof so that their upper portions can extend along the front side of the reed 6 in the disposition shown in FIG. 10A. As in the previous cases, the lateral distance between the pair of forks 23 is larger than the maximum lateral size of the detection mechanism 30. The supporting plate 83 is further accompanied with a spring 86 one end of which is hooked onto the rear side horizontal pin 82 whereas the other end of which is hooked onto the front side horizontal pin 84. This spring 86 urges the supporting plate 83 to turn about the rear side horizontal pin 82 in the clockwise direction in FIG. 10A.

In combination with the displacement mechanism 20 of the above-described construction, a cam plate 87 having a cam surface 87*a* on the side confronting the displacement mechanism 20 is fixed at its lower end to the rear surface of the bracket 31 by set screws 88.

When the lathe 1 and its related parts assume their rearmost position, the cam follower roller 85 and its associated parts are free of control by the cam plate 87. So, thanks to the repulsion of the spring 86, the upper portions of the forks 23 are always kept in resilient pressure contact with the front side of the reed 6 and the cam follower roller 85 is kept in resilient pressure contact with the cam surface 87*a* of the cam plate 87.

As the beating motion starts, the lathe 1 and its related parts including the displacement mechanism 20 moves forwardly and approaches the cam plate 87.

FIG. 10A shows the very moment whereat the cam follower roller 85 comes into contact with the cam surface 87*a* of the cam plate 87.

With further forward movement of the lathe 1 and its related parts, the cam follower roller 85 is gradually pushed down due to the inclination of the cam surface 87*a* and the supporting plate 83 turns counterclockwisely about the pin 82 in the drawing overcoming the repulsion by the spring 86. Because the forks 23 are fixed in one body to the supporting plate 83, the upper portion of the forks 23 move away from the reed 6 and move towards the detection mechanism 30.

This forward movement of the forks 23 urges the weft ends Wa to move forwardly and, upon arrival at the inlet opening of the detection mechanism 30, into the weft end passage 36. At the very moment of beating, the reed 6 beats the cloth-fell C and the forks 23 move forwardly of the reed 6, i.e. forwardly of the cloth-fell C, as shown in FIG. 10B. In this disposition, the weft end Wa is completely brought into the center gap 34 of the detection mechanism 30.

After completion of beating, the lathe 1 and its related parts move rearwardly, the cam follower roller 85 climbs along the cam surface 87*a* of the cam plate 87 and the supporting plate 83 and its associated parts turn clockwisely about the pin 82 in the drawing due to the inclination of the cam surface 87*a* and repulsion of the spring 86.

As the lathe 1 and its related parts further move rearwardly, the cam follower roller 85 is set free of the control by the cam plate 87, the repulsion by the spring 86 turns the supporting plate 83 and its associated parts further clockwisely in the drawing about the pin 82 and, due to this turning, the forks we resume their resilient pressure contact with the front side of the reed 6. Successful insertion of the weft W is detected when the weft end Wa passed through the weft end passage 36 of the detection mechanism 30 and the weft end Wa is reliably retained within the center gap 34 thereof.

As is clear from the foregoing description, the following advantages are brought about through employment of the present invention.

1. As the weft end is positively forced to move into the photoelectric detection zone in tensed condition by the forks, reliable photoelectric detection can be practiced without failure.

2. As the weft end is retained within the center gap of the detection mechanism once it is introduced into the gap, occurence of such mulfunctions as double detection which is otherwise often caused by whipping of the weft end can effectively be prevented.

3. As the photoelectric detection zone can well be isolated from outside of the apparatus, the invention can advantageously be applied to water jet looms on which wetting of the photoelectric cell and its associated parts tends to produce noises in the detecting operation.

We claim:

1. Apparatus for detecting success in weft insertion on shuttleless looms of the type wherein two sets of angularly separated warp threads (T) and two sets of angularly separated additional warp threads (Ta) laterally displaced from said warp threads are both attached to a common fabric, a weft ejection nozzle on one side of said fabric ejecting a weft thread into open sheds formed by warp threads and additional warp threads, and wherein a lathe moves a reed for beating said weft thread against said warp threads at a cloth-fell line (6) to form said fabric (F), the improvement comprising, in combination, a displacement mechanism (20) disposed, on the side of the warp threads opposite to the weft ejection nozzle, to the front side of the lathe (1) at a lateral position between the warp (T) and the additional warps (Ta) and having a pair of forks (23) laterally spaced from each other which extend in a direction crossing the plane including the fabric (F) and movable to a position forwardly of the cloth-fell line at the very moment of cloth-fell beating by the reed for moving the weft end across said cloth-fell line (6) and a detection mechanism (30) fixed to the loom at a position forwardly of said cloth-fell line and aligned with said displacement mechanism to receive the end of said weft thread and provided with means for photoelectrically detecting the weft end, a center gap (34) formed forwardly of said photoelectric detecting means, and containing means for retaining the weft end therein, thereby, forward motion of said forks of said displacement mechanism urges said weft end to move, across said cloth-fell line, into said center gap through the operational zone of said photoelectric detecting means of said detection mechanism.

2. Apparatus as claimed in claim 1 in which the lateral distance between said pair of forks (23) of said displacement mechanism is larger than the maximum width of said detection mechanism.

3. Apparatus as claimed in claim 1 further comprising a heat cutter (5) for trimming selvage (5a) from said fabric, in which said detection mechanism (30) is located at a lateral position between the heat cutter (5) and the trimmed selvage (Sa).

4. Apparatus as claimed in claim 1 in which the rear end of said detection mechanism (30) is somewhat forwardly of said cloth-fell line.

5. Apparatus as claimed in claim 1 in which the reed is contained in a reed cap (7) in which said forks (23) are fixed to the front side of the reed cap (7) and extend downwardly almost parallel to said reed.

6. Apparatus as claimed in claim 1 in which said displacement mechanism further includes means for positively moving said forks with respect to said lathe to said position forwardly of said cloth-fell line at least at the very moment of cloth-fell beating.

7. Apparatus as claimed in claim 6 in which said positive moving means includes a horizontal shaft (73) axially turnably supported on the front side of said lathe on which said pair of forks are fixedly mounted while extending upwardly, a spring (75) disposed to said shaft in such an arrangement as to urge, via said shaft, said forks to swing towards said reed and means for urging, via said shaft, said forks to swing forwardly against the spring force at least at the very moment of cloth-fell beating.

8. Apparatus as claimed in claim 7 in which the lathe is driven by a pivotally attached crank arm, in which said forks urging means includes a connecting lever (76) fixed at its front end to the outer end of said shaft and provided at its rear end with a rotatable cam follower roller (77), and a pseudo sector-shaped cam (78) fixed to the junction of said lathe to the crank arm, said cam follower roller being always kept in resilient pressure contact with said cam due to the repulsion by said spring.

9. Apparatus as claimed in claim 6 in which said positive moving means includes a stand, supporting plate (83) pivoted to said stand (81) fixed to the front side of said lathe on which said pair of forks are fixedly mounted while extending upwardly, a spring (86) disposed to said supporting plate in such an arrangement as to urge, via said supporting plate, said forks to swing towards said reed and means for urging, via said supporting plate, said forks to swing forwardly against the spring force at least at the very moment of cloth-fell beating.

10. Apparatus as claimed in claim 9 in which said forks urging means includes a cam follower roller (85) rotatably carried by said supporting plate, and a cam plate (87) fixedly mounted to a side of said loom and having a cam surface (87a) confronting said lathe, the forward movement of said lathe for the beating motion causing forward swinging of said forks against the spring force through resilient pressure contact of said cam follower roller with said plate cam.

11. Apparatus as claimed in claim 1 in which said detection mechanism includes a holding block (32) fixed to a side of said loom and having upper and lower tongues (33a, 33b) extended rearwardly and defining said center gap between them, a weft passage (36) communicating to said center gap being left between rear end portions (35a, 35b) of said tongues, said center gap is provided with a hook-shaped projection to prevent whipping-out and jumping-out of weft ends once brought into said center gap, and said photoelectric detecting means includes a light source (38) disposed to said rear end portion of one of said tongues, and a photoelectric cell (39) disposed to said rear end portion of the other of said tongues in line with said light source.

12. Apparatus as claimed in claim 11 in which said hook-shaped projection is provided on at least one of said rear end portions of said tongues and projects into said center gap.

13. Apparatus as claimed in claim 11 further comprising means for preventing wetting of said photoelectric detecting means.

14. Apparatus as claimed in claim 13 in which said light source is disposed to said rear end portion of said upper tongue, said photoelectric cell is disposed to said rear end portion of said lower tongue, and said wetting preventing means includes means for pneumatically blowing a gas over the light emitting terminal and its vicinity of said light source rearwardly, and a transparent pane (51) covering the light receptive terminal and its vicinity of said photoelectric cell.

15. Apparatus as claimed in claim 14 further comprising an eaves (43) disposed to said rear end portion of said upper tongue surrounding said light emitting terminal and its vicinity of said light source in such an arrangement as to cause water deposited on said rear end portion to flow into said center gap.

16. Apparatus as claimed in claim 14 in which said pneumatic blowing means includes an air conduit (48) extending rearwardly and downwardly through said upper tongue, the upstream terminal of said air conduit being connected to a given supply source of compressed air and the downstream terminal thereof opens in a beam path (47*a*) formed downwardly of said light source.

17. Apparatus as claimed in claim 13 in which said photoelectric cell is disposed to said rear end portion of said upper tongue, said light source is disposed to said rear end portion of said lower tongue and said wetting preventing means includes means for pneumatically blowing gas over the light receptive terminal and its vicinity of said photoelectric cell rearwardly, and a transparent pane covering the light emitting terminal and its vicinity of said light source.

18. Apparatus as claimed in claim 17 further comprising an eaves disposed to said rear end portion of said upper tongue surrounding said light receptive terminal and its vicinity of said photoelectric cell in such an arrangement as to cause water deposited on said rear end portion to flow into said center gap.

19. Apparatus as claimed in claim 17 in which said pneumatic blowing means includes an air conduit formed extending rearwardly and downwardly through said upper tongue, the upstream terminal of said air conduit being connected to a given supply source of compressed air and the downstream terminal thereof opening in a beam path formed downwardly of said photoelectric cell.

20. Apparatus as claimed in claim 13 in which said light source is disposed to said rear end portion of said upper tongue, said photoelectric cell is disposed to said rear end portion of said lower tongue and said wetting preventing means includes means for pneumatically blowing gas over the light emitting terminal and its vicinity of said light source, a transparent pane covering the light receptive terminal and its vicinity of said photoelectric cell, and a resilient lip (61) disposed to the rear end of said upper tongue with a lower edge thereof in contact with said transparent pane in such an arrangement as to close the rear opening of said weft end passage.

21. Apparatus as claimed in claim 20 in which said blowing means includes an air conduit (62) formed through said upper tongue into which the light emitting terminal of said light source is exposed, the upstream terminal of said air conduit being connected to a given supply source of compressed air, and wherein said beam path (63) for said light source opens in said air conduit.

22. Apparatus as claimed in claim 21 in which said blowing means includes an air conduit formed through said upper tongue into which the light receptive terminal of said photoelectric cell being exposed, the upstream terminal of said air conduit is connected to a given supply source of compressed air, and wherein a beam path for said photoelectric cell opens in said air conduit.

23. Apparatus as claimed in claim 13 in which said photoelectric cell is disposed to said rear end portion of said upper tongue, said light source is disposed to said rear end portion of said lower tongue and said wetting preventing means includes means for pneumatically blowing gas over the light receptive terminal and its vicinity of said photoelectric cell, a transparent pane covering the light emitting terminal and its vicinity of said light source, and a resilient lip disposed to the rear end of said upper tongue with a lower edge in contact with said transparent pane in such an arrangement as to close the rear opening of said weft end passage.

24. Apparatus as claimed in claim 1 further comprising means for smoothly guiding said weft end into said center gap of said detection mechanism in response to urging by said forks of said displacement mechanism.

25. Apparatus as claimed in claim 24 in which said guiding means includes guide plates (64, 66) disposed to both sides of said detection mechanism.

* * * * *

UNITED STATES PATENT OFFICE
CERTIFICATE OF CORRECTION

Patent No. 3,978,893 Dated September 7, 1976

Inventor(s) Mitsugu Inagawa, et al

It is certified that error appears in the above-identified patent and that said Letters Patent are hereby corrected as shown below:

Column 7, line 30: "jamp" should be --jump--.

Column 9, line 34: "we" should be deleted.

line 49: "mulfunctions" should be --malfunctions--.

Column 12, line 41: "claim 21" should be --claim 1--.

line 44: "being" should be --is--.

line 45: "is" should be --being--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*